US005129456A

United States Patent [19]

Bódás et al.

[11] Patent Number: 5,129,456

[45] Date of Patent: Jul. 14, 1992

[54] DRY-OPERATED CHIMNEY COOLING TOWER

[75] Inventors: János Bódás; István Papp; György Pálfalvi, all of Budapest, Hungary; Sergei Trusin; Georgii S. Agaiev, both of Moscow, U.S.S.R.

[73] Assignee: Energiagazdalkodasi Intezet, Budapest, Hungary

[21] Appl. No.: 784,689

[22] Filed: Oct. 30, 1991

Related U.S. Application Data

[63] Continuation of Ser. No. 329,658, Mar. 28, 1989, abandoned.

[51] Int. Cl.[5] ..... F28D 1/00

[52] U.S. Cl. ..... 165/108; 165/900; 165/129

[58] Field of Search ..... 165/108, 900, 129

[56] References Cited

U.S. PATENT DOCUMENTS

| | | | |
|---|---|---|---|
| 3,443,633 | 5/1969 | Carnavos | 165/108 |
| 4,450,899 | 5/1984 | Jakobsson et al. | 165/108 |
| 4,531,576 | 7/1985 | Kals | 165/108 |
| 4,747,980 | 5/1988 | Bakay et al. | 165/900 |
| 4,909,309 | 3/1990 | Palfalvi et al. | 165/900 |

FOREIGN PATENT DOCUMENTS

| | | | |
|---|---|---|---|
| 1110614 | 10/1981 | Canada | 165/900 |
| 0006412 | 1/1980 | European Pat. Off. . | |
| 0220607 | 5/1987 | European Pat. Off. . | |
| 2018870 | 11/1971 | Fed. Rep. of Germany | 165/900 |
| 2836053 | 2/1980 | Fed. Rep. of Germany | 165/900 |
| 1235872 | 5/1960 | France . | |
| 1489921 | 6/1967 | France . | |
| 2360059 | 2/1978 | France | 165/900 |
| 0049403 | 4/1979 | Japan | 165/900 |
| 902400 | 8/1962 | United Kingdom | 165/900 |
| 1333764 | 10/1973 | United Kingdom | 165/900 |
| 2008738 | 6/1979 | United Kingdom | 165/900 |

*Primary Examiner*—John K. Ford
*Attorney, Agent, or Firm*—Handal & Morofsky

[57] ABSTRACT

A dry-operated chimney cooling tower suitable for cooling warm water from a power station and operating with a natural draft, is provided with downstream jalousies to assist in frost protection and energy conservation. These jalousies can be capable of forming a "diving bell" like enclosure around air radiators to contain warmed air therearound.

6 Claims, 3 Drawing Sheets

DRY-OPERATED CHIMNEY COOLING TOWER

This application is a continuation of application Ser. No. 329,658, filed Mar. 28, 1989, now abandoned.

TECHNICAL FIELD

The present invention relates to a dry-operated chimney cooling tower. Dry-operated cooling towers are used in industry and in electric power-generation plants. In such towers warm water is cooled in air radiators without evaporation and waste heat is released to the atmosphere.

BACKGROUND

In order to give some idea of the dimensions used, it is noted that a unit in a power plant with an output of 200 kW, which can be considered nowadays as a facility with a small output, can have the following parameters for dry-cooling:

| | |
|---|---|
| heat to be extracted | 300 MW |
| cooling water flow | 7 $m^3/s$ |
| height of the tower | 120 m |
| lower diameter | 110 m |
| ribbed surface area of its air radiators | 600 000 $m^2$ |
| air-cooling mass | 600 tons |

With such dimensions, natural-draft chimney cooling towers are considered as economical. Draft and air flow caused thereby are formed almost immediately, as soon as warm water arrives at the air radiator.

The prior art provides many proposals for dry-operated cooling towers with both natural draft and forced circulation of the cooling air, for example U.S. Pat. No. 4,747,980 Bakay et al. and German Patent Application No. 28 36 053.

In the dry-operated cooling towers movable or adjustable jalousies are frequently used to control the air flow and regulate the output of the tower.

Previously, jalousies for the control of air flow have been used both with cooling towers having ventilators and with chimney cooling towers. Jalousies are effective for regulating heat output in two different types of cooling tower most widely used in practice. One type of cooling tower having what is known as a "Heller-arrangement" is characterized in that air radiators are installed along the lower diameter of the tower, next to each other with water flowing vertically in the pipes. Cooling air is led horizontally into the tower and exits up the chimney. Jalousies are installed before the coolers. This technique has the advantage that the jalousies offer particularly in their closed position protection for the air radiators against both damage and contamination.

Such a construction is suggested in Bakay et a which states that its teaching is applicable to natural draft cooling towers although the specific teaching focuses on forced-draft systems.

A second type of cooling tower uses air radiators which are arranged horizontally inside the tower. Air radiators can be installed either radially or parallel with each other. In this case also, the jalousies serving for the regulation of the air flow are arranged on the inflow side of the air, i.e. they are arranged under the air radiators.

Both these techniques are effective for the control of the mass of air streaming through the air radiators and, accordingly, for regulating the output of the air radiators. They are also useful when disconnecting the air radiators to take them out of operation.

A well-known problem associated with the operation of dry cooling towers in cold weather and, in particular, with start-up in cold weather, is frosting or freeze up. Various solutions have been proposed which pre-heat the air radiators prior to filling them with water.

One solution for pre-heating air radiators became known as the "Heller-towers" and employs the feature that between the vertically arranged coolers and the regulating jalousies there are arranged smaller dimensioned ventilators blowing-in warm air. The air is allowed to stream through the air radiators and heats them gradually. The ventilators can include an air radiator also heated with water, however, this is far smaller than the cooling radiators. Accordingly, neither start-up nor filling the ventilators is considered to present any danger of freeze up. However, this type of pre-heating has the drawback of requiring a considerable expenditure on heating and of generating an intense air flow, as the warm air leaves the chimney and is lost.

Some problems which may arise are: When the cooling tower is started-up and the heat received from the medium to be cooled is not sufficient, the water system can become unduly cooled and may ice up.

If a previously disconnected group of air radiators is brought into operation frosting may arise.

Adjustable, that is, movable jalousies used in dry-operated cooling towers, may reduce the air flow within the tower to such an extent that an adequate warm-air draft cannot be created. The warm air is unable to fill out the whole cross-section of the relevant radiator, while local motion of air tending to move upwards may be equalized or offset by heavy cold air entering on the top of the tower.

Such air radiators usually have a plurality of parallel-connected water pipe are arranged. So e.g for example, referring to the cooling tower mentioned above, water may flow through as many as 30,000 pipes with a diameter of 17 mm, and a length of about 30 m. As mentioned above, in the [single] individual pipes or on the surface of the air radiator, freezing may occur, resulting in damage, or blockages in the pipes and in the air radiators. It is clear that 600 tons of cold metal mass, according to our example, is readily able to freeze water during filling and, to seal the pipes by icing. Frost may also occur during discharge, in such a manner that water is discharged too slowly and the remaining water is frozen.

In order to achieve a frost-free filling and discharge, it is known to pre-heat the cold air radiators and keep them warm, by stopping air-flow through the air radiators during filling and discharge.

A common characteristic of known pre-heating equipment is the blowing of warm air into the outer side of the air radiator. The warm air, after having passed through the air radiator, flows directly to the chimney of the cooling tower and is lost. With the dimensions and outputs of the example above, such lost heat is substantial and expensive.

SUMMARY AND OBJECTS OF THE INVENTION

Accordingly an object of the invention is to provide a dry-operated chimney cooling tower of the natural draft type having improved means for heating its radiators.

It is a further object of this invention to provide such a cooling tower with improved radiator heading means which can reduce heat losses from the tower, especially during start-up or during filling or discharging of the radiators and which heating means can preferably also be used for the continuous heating of the radiators.

The present invention uses the concept of arranging the air radiators inside the cooling tower and positioning the jalousies that regulate air flow not upstream of the air radiators but, rather, downstream of the air radiators, in a manner such that the jalousies forming a closed space above the air radiators. The structural arrangement can be similar to a diving bell, the warm pre-heating introduced air can be contained and utilized continuously for pre-heating the air radiators, whereby use of an external heat source for preheating is avoided.

Thus, the invention provides a dry-operated chimney cooling tower for cooling warm water without evaporation in which cooling tower preferably ribbed air radiators for warm water flow are arranged horizontally, while adjustable jalousies are provided to control the intensity of cooling and a pre-heating unit blowing-in warm air, is provided.

Further, according to the invention the jalousies are arranged above the air radiators in a horizontal plane. The cooling tower can be provided with a further adjustable jalousie, which is arranged above the previously mentioned jalousie, on the mantle-part of the cooling tower or with a jalousie lying in the plane of the air radiators, between the air radiators and the wall of the chimney of the cooling tower. Further jalousies can be provided which are arranged below the plane of the air radiators, in another horizontal plane.

The pre-heating unit can comprise a part of the air radiators which is provided with a ventilator or fan which discharges into a space upstream of the air radiators, below the jalousies. In an optional embodiment the heating unit may be provided with a heat-exchanger containing a frost-resistant liquid i.e. an anti-freeze. The heating unit may be connected to an external heat source and may also be provided with automatic devices controlled by a heat-sensor.

A dry-operated chimney cooling tower according to the present invention can provide the following advantages:

At start-up of the cooling tower and when the heat coming from the medium to be cooled is not adequate for prewarming because the water system is filled with somewhat cool water, the hot air introduced for pre-heating the air radiators may be trapped in a closed space around the air radiators and can be utilized as long as the air radiators stay frost-free.

In such a manner the pre-heated air is blown-in for pre-heating the air radiators, not wasted, resulting in a significant saving of energy.

When bringing into operation a group of air radiators which has been previously disconnected, the danger of frost can be eliminated by the warm air stored in the space around the radiators and without the introduction of supplementary hot air.

By the arrangement according to the present invention, it can become possible to eliminate the need for an external heat source for the pre-heater unit by using a part of the air radiators, that is, a group thereof, as the heating unit, while a fan blows hot air through the air radiator.

BRIEF DESCRIPTION OF THE DRAWINGS

The invention will be described in more detail in some preferred embodiments, with reference to the accompanying drawings, wherein.

BEST MODE FOR CARRYING OUT THE INVENTION

Figure 1:
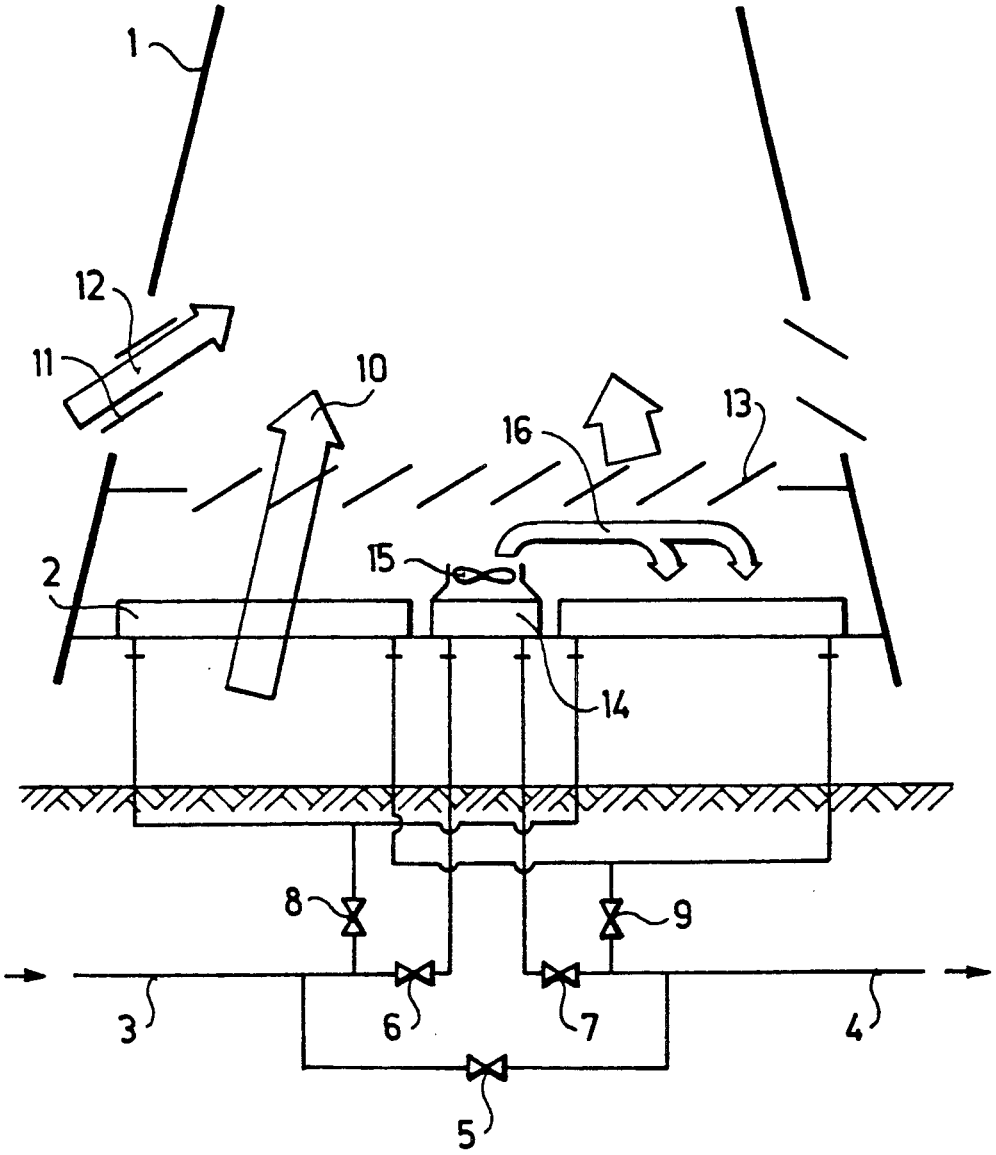
FIG. 1 illustrates schematically a dry-operated chimney cooling tower provided with jalousies and constructed according to the invention.

FIG. 1 illustrates a chimney cooling tower 1. On the bottom of the cooling tower per se known air radiators 2 are installed, whose purpose is to cool water by means of an air stream indicated by the arrow 10. Air radiators 2 communicate with a pipeline 3 supplying water to be cooled and with a pipeline 4 removing cooled water under the control of valves 6, 7, 8 and 9. Pipelines 3 and 4 are interconnected by a by-pass line containing a valve 5.

A jalousie 13 is arranged above the air radiators 2, while a jalousie 11 is arranged on the mantle of the cooling tower 1.

A part of the air radiators 2, in this example, the central part, is formed as the heating unit 14, which is provided with a fan 15.

Figure 2:
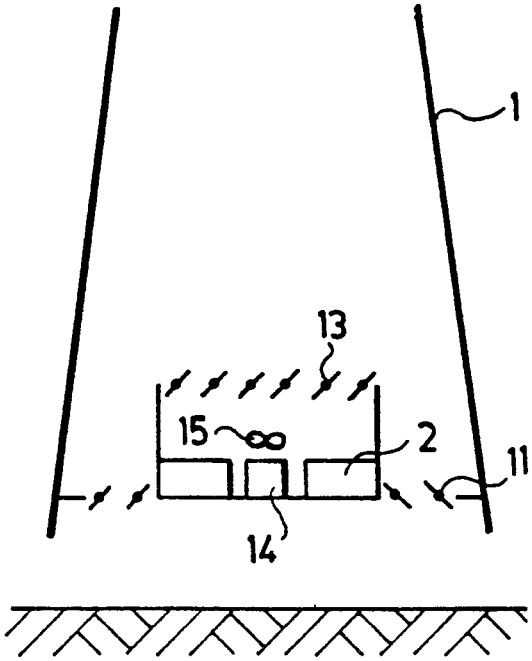
FIG. 2 is a schematic view similar to FIG. 1 of a cooling tower provided with an additional jalousie construction arranged generally in the plane of some horizontal air radiators.

The embodiment according to FIG. 2 differs from the embodiment according to FIG. 1, in that the jalousie 11 is not arranged on the mantle of the cooling tower 1, but it is arranged inside the tower 1, generally co-planar with the bottoms of the air radiators 2.

Figure 3:
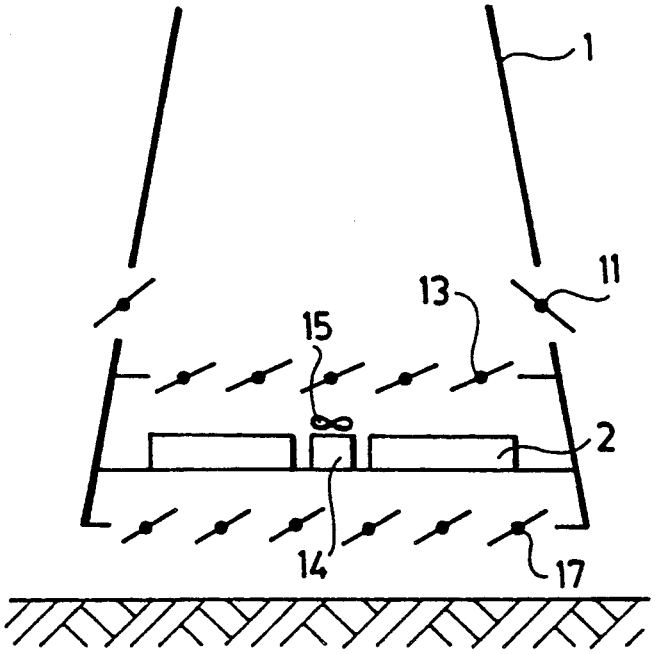
FIG. 3 is a schematic view similar to FIG. 1 of a cooling tower provided with further jalousies below the air radiators.

In the event, the cooling tower is to be used in an extremely cold environment, the embodiment shown in FIG. 3 may be desirable. In addition to the jalousie 13 and the jalousie 11 on the mantle of the cooling tower, there is a jalousie 17 formed below the air radiators 2. By this means, the air radiators 2 are arranged in a completely closable space, consequently, the heating unit 14 can be warmed rapidly.

For frost-free filling and discharge of the radiators, it may be desirable to construct the heating unit 14 from ribbed pipes with diameters larger than usual. By increasing the pipe diameter, the danger of freezing can be considerably reduced.

Figure 4:
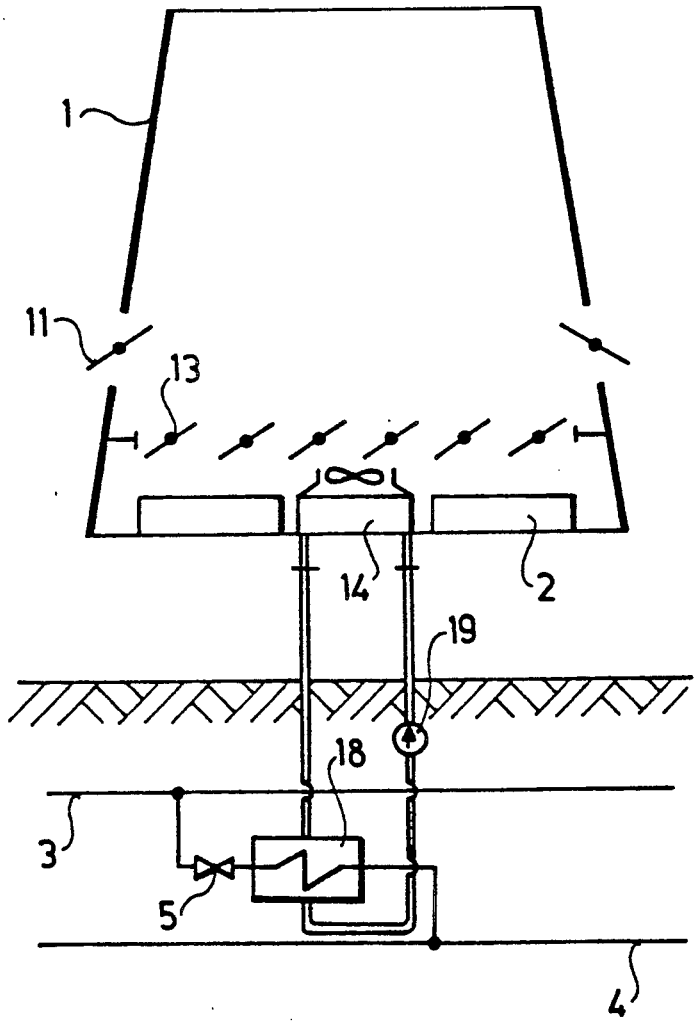
FIG. 4 is a further schematic view similar to FIG. 1 of a cooling tower where the air radiator includes a heat-exchanger, in one brance of which a frost-resistant liquid is contained, to serve as a heating unit.

In FIG. 4, an embodiment is illustrated in which in order to achieve more reliable discharging and to avoid freeze-ups, heating unit 14 is filled with a frost-resistant medium, such as an antifreeze solution or oil. In this case, the by-pass line interconnecting the pipeline 3 delivering the water to be cooled with the pipeline 4 delivering cooled water, is connected to a heat-exchanger 18 on the other side of which the frost-resistant liquid is contained. A pump 19 is installed to circulate the frost-resistant liquid.

The dry-operated cooling tower, as shown in FIG. 1, operates with a natural draft and the air radiators 2 cool the water arriving through the pipeline 3 by the air stream indicated with the arrow 10. Cooled water leaves the system through the pipeline 4.

For start-up of the cooling tower, the valves 6, 7 8 and 9 are closed, there is no water in the air radiators 2 and water flows through the by-pass line through the valve 5. During start-up, the jalousie 13 above the air radiators 2 is closed so that the air radiators 2 are arranged in a chamber which opens downwardly and is closed upwardly, similarly to a "diving bell". Also during start-up of the cooling tower, the jalousie 11 on the mantle of the cooling tower can be opened so that if a down draft is created in the cooling tower 1, cold air 12 streaming through the jalousies 11 will stop the downdraft.

In this mode the valves 6 and 7 are opened and the water to be cooled flows into the heating unit 14. Thereafter the fan 15 is activated and warm air flow, indicated by the arrows 16, fills the space below the jalousie 13 and heats the air radiators 2. Air passing through the air radiators 2 recirculates from beneath them into the heating unit 14. Thus, continuous circulation of warm air is established.

After completing the pre-heating of the air radiators 2, which can be confirmed by measuring their surface temperatures the valves 8 and 9 are opened and the valve 5 is closed. Now, all air radiators 2 are operating. After the air radiators are filled, jalousie 11 is closed and jalousie 13 is opened to a degree dependent on the desired cooling output.

It, is clear, that after filling the radiators 2, the fan 15 is turned off and the heating unit 14 can operate similarly to the other air radiators 2.

When the operation is to be carried out in cold weather, first of all the jalousie 13 is closed. Now the air stream indicated by the arrow 10 is substantially reduced. At the same time, the jalousie 11 is opened and, the resultant cold air stream 12, stops any downdraft. Now, the fan 15 is turned on and, while maintaining the flow of warm air, indicated by the arrow 16, air radiators 2 are discharged. Finally, heating unit 14 can be dewatered and the fan 15 turned off.

The jalousies can be actuated automatically so that, for example, valves 6, 7, 8 and 9 open only in the closed state of the jalousie 13 and in the open state of jalousie 11. The jalousie 11 closes when filling is finished, as indicated by closing of the valve 5.

In the course of regulating the jalousies and ventilators, one has to consider that pre-heating is required, if there is a danger of frost. It may be desirable to provide the heating unit with automatic devices controlled by a per se known heat-sensor.

We claim:

1. A dry-operated natural draft cooling tower for cooling warm water without evaporation which comprises:

a) A generally vertical chimney having means to admit air thereto and designed to draw a natural draft;

b) at least one air radiator disposed primarily horizontally across the chimney in the path of said natural draft;

c) pipeline means to pass warm water through the air radiator for cooling;

d) closable primary jalousies mounted in the chimney downstream of the air radiator to regulate the flow of said natural draft;

e) radiator enclosure means including said primary jalousies and co-operating therewith so that in a closed position of the jalousies, the enclosure means prevents the flow of said natural draft over the air radiator;

f) a pre-heater to supply warm air in said radiator enclosure means which includes a blower co-operable with said enclosure means to recirculate warmed air over the air radiator to warm it; and g) closable secondary jalousies disposed in a lower part of the cooling tower structure to admit air to the chimney and draw a draft in the chimney; wherein said secondary jalousies are operable independently of said primary jalousies to cause an upward draft in the chimney when said primary jalousies are closed.

2. A cooling tower according to claim 1, wherein the pre-heater is disposed to discharge warm air above the air radiator and draw cold air from beneath the air radiator whereby natural convection can draw warm air down through the air radiator while cold can assist recirculation.

3. A cooling tower according to claim 2, wherein the pre-heater comprises a pre-heater radiator suppliable with fluid carrying heat from said warm water.

4. A cooling tower according to claim 3, wherein the air radiator and the pre-heater radiator are generally planar and are disposed substantially horizontally and side-by-side for air to flow through them vertically.

5. Dry-operated chimney cooling tower as claimed in claim 1, wherein said secondary jalousies are arranged in the plane of the air radiators between the air radiators and the wall of the cooling tower.

6. Dry-operated chimney cooling tower as claimed in claim 1, wherein said secondary jalousies are arranged on the mantle part of the cooling tower above said primary jalousies and wherein further additional jalousies are arranged in a horizontal plane below the plane of the air radiators.

* * * * *